US006347406B1

(12) United States Patent
Jones et al.

(10) Patent No.: US 6,347,406 B1
(45) Date of Patent: Feb. 19, 2002

(54) SPORTSMAN'S WEARABLE SEAT SYSTEM

(75) Inventors: Brent Jones; Keith Littlefield, both of Greer, SC (US)

(73) Assignee: Innovative Sports, Inc., Greer, SC (US)

( * ) Notice: Subject to any disclaimer, the term of this patent is extended or adjusted under 35 U.S.C. 154(b) by 0 days.

(21) Appl. No.: 09/846,027

(22) Filed: Apr. 30, 2001

(51) Int. Cl.[7] ..... A45F 4/02; A47C 1/00
(52) U.S. Cl. ..... 2/69; 224/155; 297/4
(58) Field of Search ..... 2/69, 102, 93–94, 2/85–86, 108, 455, 46; 224/153, 155, 627; 297/4, 59, 31, 1

(56) References Cited

U.S. PATENT DOCUMENTS 5,560,524 A * 10/1996 Brune ..... 224/153
5,779,112 A * 7/1998 Krulik ..... 224/155
5,957,349 A * 9/1999 Krulik ..... 190/8

* cited by examiner

*Primary Examiner*—John J. Calvert
*Assistant Examiner*—Tejush Patel
(74) *Attorney, Agent, or Firm*—Brent Jones; Keith Littlefield

(57) ABSTRACT

A wearable seating system that is suitable for a sportsman's use. A body garment is provided that includes an attached, integrated seat, with support base, that may be easily deployed in the field with minimal manipulation by the user. The integrated seat, when deployed, may be easily stowed upon garment for transport, with minimal manipulation by the user, and causing minimal obstruction to the user while so stowed.

19 Claims, 10 Drawing Sheets

SPORTSMAN'S WEARABLE SEAT SYSTEM

FIELD OF THE INVENTION

The present invention relates to an apparatus that provides a wearable seat system for sportsmen. More specifically, the present invention provides a seat system with a body garment that includes an easily deployed, elevated portable seat integral to the garment.

BACKGROUND OF THE INVENTION

Outdoor activities such as hunting, fishing, nature watching, wildlife photography, and the like have long enjoyed great allure for the sportsman. By definition, all such sporting activities are conducted within the natural elements, and many are often conducted over rugged terrain. Moreover, many such sporting activities involve periods of movement from one location to another, punctuated by periods of stationary activity at a given location—the hunter must quietly await his quarry, the fisherman must cautiously wait for his cast bait to be sensed, the nature watcher must unobtrusively observe the target of her efforts, the wildlife photographer must stealthily record her subjects. Depending upon the particular activity in which the person is engaged, any number of movements during the day are possible, and indeed a great number of such movements may be required. Between each such movement, the outdoorsperson often is advantaged, for both rest and observation, by stationary interludes. Furthermore, the demands of such movement over such terrain often necessitate intermittent periods of rest to promote the relaxation and sense of nature that brings many to the outdoors in the first place.

For many such activities in the wild that involve periods of being stationary, the necessities of stealth encourage the sportsperson to be seated so as to present less observable profile to cautious, fearful wildlife. Indeed, much of the outdoorsman's time spent in pursuit of his hobby is in a seated position, because such a position offers so many advantages to the objective of the sport. After all, so seated, the sportsman is less visible and obtrusive and thereby enhances his probabilities of intercepting game animals, and even in the absence of such wildlife the sportsman may more fully enjoy the relaxing experience of the great outdoors.

The great outdoors is not furnished with chairs. Without more than is naturally provided, the sportsman must sit on the earth, on fallen leaves, on a fallen tree of whatever orientation, on a tree stump of whatever height and width, or the like. Furthermore, the problem is not only one of mere discomfort. A hunter is benefited by positioning himself near naturally occurring camouflage such as bushes, thickets, or low-lying trees; nature provides no guarantee of a seat at such locations. An angler is benefited by positioning himself nearer to the fish; nature provides no guarantee of a seat at such locations. The nature watcher often attempts to blend in with the environment so as to better observe her quarry in an undisturbed state; nature provides no guarantee of a seat at an ideal location. And the wildlife photographer often wants to record game when it is unaware of the photographer's presence; nature provides no guarantee of a seat at a location to best achieve that goal.

Ground conditions at a given location certainly cannot be predicted in advance. They may be noisy with dried tree leaves that would alert native wildlife; they may be wet with rain, moisture, or absorption from nearby water that would quickly soak the sportsman's clothing; they may be irritating with gravel, rocks, twigs, or ground dwelling insects that would encourage fidgeting; or they may otherwise be of a character that would distract from the goal that brought the sportsman into the wild. Sitting on the ground, then, is less than ideal in many circumstances.

Sitting at ground level also disadvantageously decreases the sportsman's field of view. Virtually every sport in the wild depends upon vision as the primary sense, and an increased field of vision heightens the experience for which the sport is pursued. Furthermore, even sitting on a mat or other type of pad at ground level has distinct disadvantages—every movement rustles the underlying dry leaves that make noise that alert native wildlife, ground moisture may still manage to seep into the sportsman's clothing and thereby cause discomfort, and underlying gravel, rocks, twigs, or ground dwelling insects are still within reach. Finally, sitting at ground level decreases the sportsman's mobility. To turn side-to-side to aim a firearm, cast a fishing lure, sight binoculars, or point a camera, the sportsman must swivel not only his hips, but also his legs, as the entirety of his lower body is upon the plane of the ground. Clearly, such movement risks conveying alarming noise to nearby game animals. Put simply, aiming a gun or casting a fishing pole, other than to a location directly in front of the sportsman, is difficult to accomplish with any aplomb, and sighting binoculars or pointing a camera is not much easier.

Of course, to address the concerns described hereinabove, the sportsman or sportswomen might bring a seat with him or her into the field. Such a seat must be easily transportable, given the many movements that might be expected in a day's activities. Such an implement must provide a decreased profile of the sportsman while he is seated, lest game be alerted. Such an implement must be capable of being situated at a variety of locations, inasmuch as conditions in the wild often cannot be predicted, yet advantageous positioning is desired. And such a system should provide elevation to the sportsman, to avoid the noise of movement upon dried leaves, the discomfort of absorbed water, the irritation of grating ground conditions, and so forth, and to provide an enhanced field of view, and to provide increased bodily mobility while upon it.

A seat brought into the field by a sportsman should also be configured to be easily deployed with minimal activity by the sportsman. Any such seating that required more than minimal manipulation to be deployed would increase the noise generated by the sportsman and would thereby tend to alert nearby wildlife. Additionally, outdoorsmen tend to carry with them other devices for their sport, such as firearms, fishing poles, cameras, and the like—they tend to have their hands full of other equipment. A seating system that allowed easy deployment without the necessity of the sportsman having to drop his other gear would provide clear advantages.

Finally, a seat brought into the field by a sportsman should also be unobtrusive to activities being conducted while the implement is being carried. As noted, such sportsmen tend to have other equipment with them, being carried through the field. A seat that only minimally, if at all, interfered with such travel would be advantageous.

Portable seating systems have been made available. For example, U.S. Pat. No. 5,620,227 describes a vest garment with pivotable seat member. The device includes a seating pad that, while being carried, is borne within the interior of the garment and, therefore, may chafe against the wearer. When deployed, the seat pad is connected by straps or the like to a back rest; by use of such straps, the back rest is held in place in relation to the seating member, so as to provide a support against which the user's back may lean while so seated. Unfortunately, the device of the '227 patent requires great manipulation of the entire garment to deploy the seating member, in that its entire length is stowed against the interior of the garment. Additionally, the device described by the '227 patent is not disposed for easy deployment of the seating member while the user might be carrying other sporting gear in his hands or upon his shoulders. Finally, the device of the '227 patent provides no supporting base between the seating member and the ground, so that the user is disposed to sit almost directly upon the ground and thereby have no elevated position upon which to manipulate his other sporting devices, such as guns, fishing poles, binoculars, and the like.

Another device is described in U.S. Pat. No. 1,626,166, for a seat pad for sportsmen's coats. As disclosed, the '166 patent describes merely a pad enclosed within a coat, for lowering from the coat so as to provide a seated positioning device. While perhaps providing comfort for the lower bony prominences while seated on gravel, rocks, or twigs, the device of the '166 patent suffers from many of the same drawbacks and disadvantages of the device of the '227 patent discussed above—it provides only a soft cushioning member between the lower bony prominences and the supporting foundational surface, yet provides no elevation and requires its user to stir upon it for side-to-side viewing during sporting activities.

Much akin to the '166 patent is U.S. Pat. No. 3,185,362, disclosing a"seat-back" that appears to suffer the same drawbacks and disadvantages as the one device described in the '166 patent.

A number of devices are described as providing back-pack systems for seating devices. Those known include the following U.S. Pat. No. 4,387,924; 6,145,716; 4,489,866; 2,843,185; 6,048,023; 5,927,798; 5,409,291; 5,318,942; 4,676,548. All appear to describe a portable seating method that may be carried upon one's back. However, none offer a simplified structure for rapid deployment of the seating system and none offer a seating system that may be deployed without first removing the entirety of the device from one's body. Such deployment, therefore, would require the user to drop any other sporting gear being carried in his hands, undergo the attention-drawing efforts of dismounting the system from his back, and assembling the system upon the ground for sitting, and reacquiring control of his sporting equipment (firearm, fishing pole, binoculars, camera, etc.) before resuming his enjoyment, all the while hoping that wildlife in the vicinity will be forgiving of the noise and disruption of these efforts.

The present invention relates to an improvement upon the known systems for wearable seat systems and provides distinct advantages over the known systems.

SUMMARY OF THE INVENTION

The present invention solves the problems and drawbacks identified above by providing a new wearable seat system. While this wearable seat system will be disclosed in terms of use by frequenters of the outdoors, the scope of the present invention is not limited to use by persons occupied in such sporting endeavors. Instead, the present invention may be used with any endeavor in which the need for portable, efficiently deployed, unobtrusive, elevated, stationary seating may arise during the course of physical exertion.

It is a principal object of the instant invention to provide a seat system that is integrated with a garment worn by the user and that is configured for deployment of the seat while the garment continues being so worn by the user and without prior detachment of the seat from the garment.

It is also a principal object of the instant invention to provide a seat system that is integrated with a garment worn by the user and that is configured for deployment of the seat while being so worn by the user and without the need to remove the garment prior to deploying the seat.

It is another principal object of the instant invention to provide a wearable seat system that is configured for deployment of a seating surface that elevates the user above ground level while being used.

It is a further principal object of the present invention to provide a seating system that is wearable into the field, that is unobtrusive when worn, that provides for rapid deployment of the seat while being worn, that affords a seating surface that is elevated above ground level, and that provides for ease of stowing for transport.

Additional objects and advantages of the invention will be set forth in part in the following description, or may be obvious from the description, or may be learned through practice of the invention.

In accordance with an embodiment of the invention, an apparatus is provided that includes a garment for wear upon the human body. Pivotally connected to the rear of the garment is a collapsible stand. The collapsible stand is configured so as to be selectively deployable by the wearer of the garment from a first mode to a second mode while the stand remains connected to the garment and while the garment is continuously worn by the wearer. The first mode defines a collapsed storage mode, and the second mode defines an open seating mode. During the seating mode, the stand is configured for supporting the wearer of the garment above the ground in a seated position. During the storage mode, the stand is configured for essentially flat storage parallel to and against the rear of the garment. While so stowed, the seating system requires no handling by the wearer and does not interfere with movement of the wearer's arms, hands, or legs.

The stand includes a frame and a bridge member. The frame can include a first brace and a second brace pivotally connected to the first brace. Each brace desirably includes a top beam having a pair of opposed ends. Each brace desirably includes a pair of opposed legs. Each leg depends from a different one of the opposed ends of the top beam of each of the braces. The bridge member has opposed ends, and one end engages the top beam of the first brace, and the second end engages the top beam of the second brace. A hinge member can be provided and configured to pivotally connect one of the top beams of one of the braces to the rear of the garment.

Some embodiments of the invention can include a hinge member that includes a first non-rigid substrate having a front edge and a back edge disposed opposite the front edge. In such embodiments, one of the edges of the hinge member can be connected to the rear of the garment. In such embodiments, the hinge member can include at least one anchor member, which can be provided and configured to pivotally connect the back edge of the substrate to one of the top beams of one of the braces.

Some embodiments of the invention can include a seat member connected to the back edge of the hinge member. The seat member can include a seat casing and a cushion. The seat casing can be formed as a non-rigid body that is configured to define a hollow interior cushion compartment therein. The seat casing can define a top, a bottom disposed opposite the top, and a peripheral border extending between the top and the bottom. The cushion is configured so that it can be received within the cushion compartment of the seat casing. In such embodiments, the at least one anchor member can be provided and configured to pivotally connect one of the top beams of one of the braces either to the back edge of the substrate portion of the hinge member or to the seat member.

At least one fastener can be provided and attached to the rear of the garment and configured and disposed to detachably fasten the stand (and the seat member, if any) to the exterior surface of the rear of the garment.

The collapsible stand folds against and is secured to the rear of the garment for easy transport by the wearer during periods of activity. When seating is desired or required, the apparatus provides for easy deployment of the stand, and any seat disposed on the stand, to a position beneath the wearer, while the stand (and seat) is still attached to the garment. Such deployment requires only minimal action by the wearer, who may be expected to be carrying other gear in his hands. This deployment to the open seat mode does not require the wearer to disrobe the garment, or to unbutton, unzip, or unhook the garment from his body. Instead, only the collapsible stand (and seat, if any) must be loosed from its storage mode. By its attachment to the garment, the loosed collapsible stand is positioned directly beneath the wearer for sitting. The collapsible stand includes braces with legs for elevating the wearer off the ground while the wearer is seated on the stand. Such elevation allows the user greater field of view, allows greater mobility to turn from side to side to aim a firearm, cast a fishing lure, or sight binoculars or a camera, and keeps the user's body dry from damp or wet conditions in the field. To transition from such seating to movement, the collapsible stand easily folds back into position against the garment and may be reattached thereto.

These and other features, aspects, and advantages of the present invention will be better understood with reference to the following description and appended claims. The accompanying drawings, which are incorporated in and constitute a part of this specification, illustrate exemplary embodiments of the invention and, together with a description, serve to explain the principles of the invention.

DETAILED DESCRIPTION OF THE PREFERRED EMBODIMENTS

Figure 1:
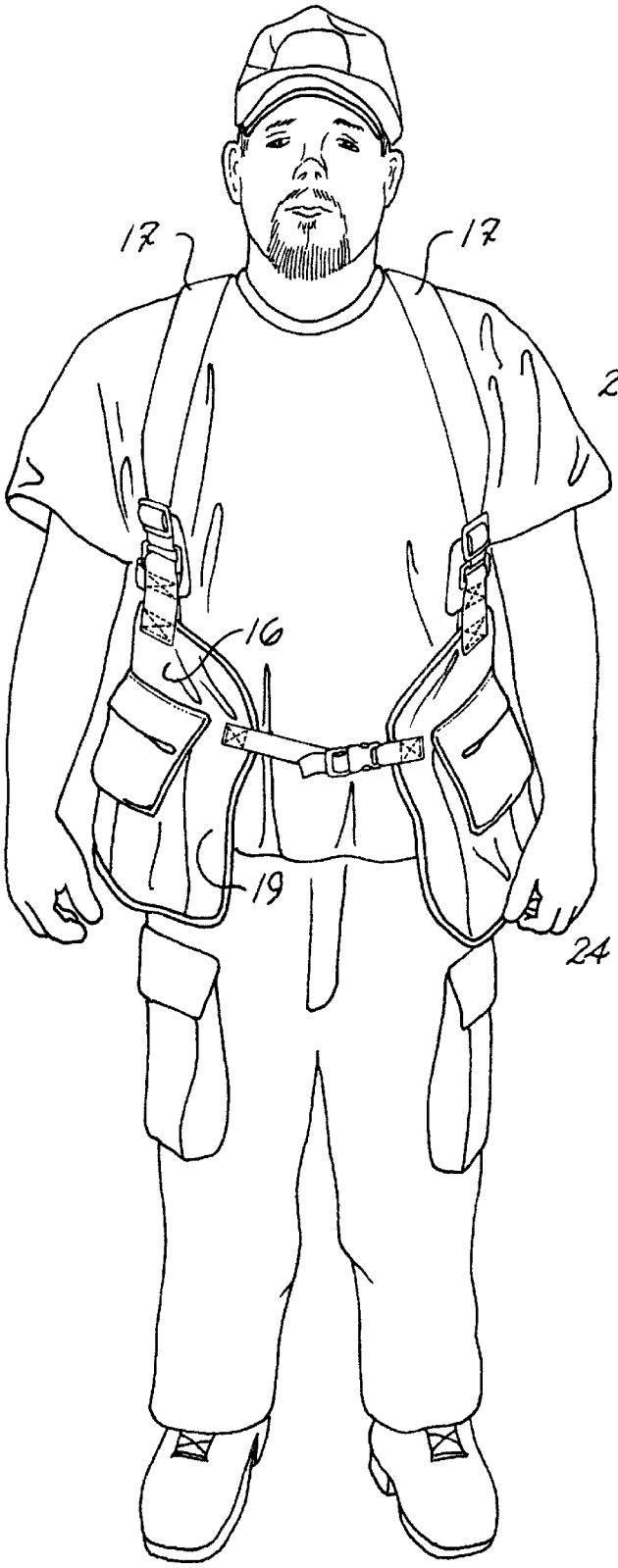
FIG. 1 is a perspective view taken from the front and showing the basic features of the presently preferred embodiment of the invention with the seat stowed for transport.

Reference now will be made in detail to the presently preferred embodiments of the invention, one or more examples of which are illustrated in the drawings. Each example is provided by way of explanation of the invention, and is not meant as a limitation of the invention. For example, features illustrated or described as part of one embodiment can be used on another embodiment to yield a still further embodiment. It is intended that the present application includes such modifications and variations as come within the scope and spirit of the invention. The same numerals are used to refer to the same features throughout the drawings and the text that follows.

Figure 2:
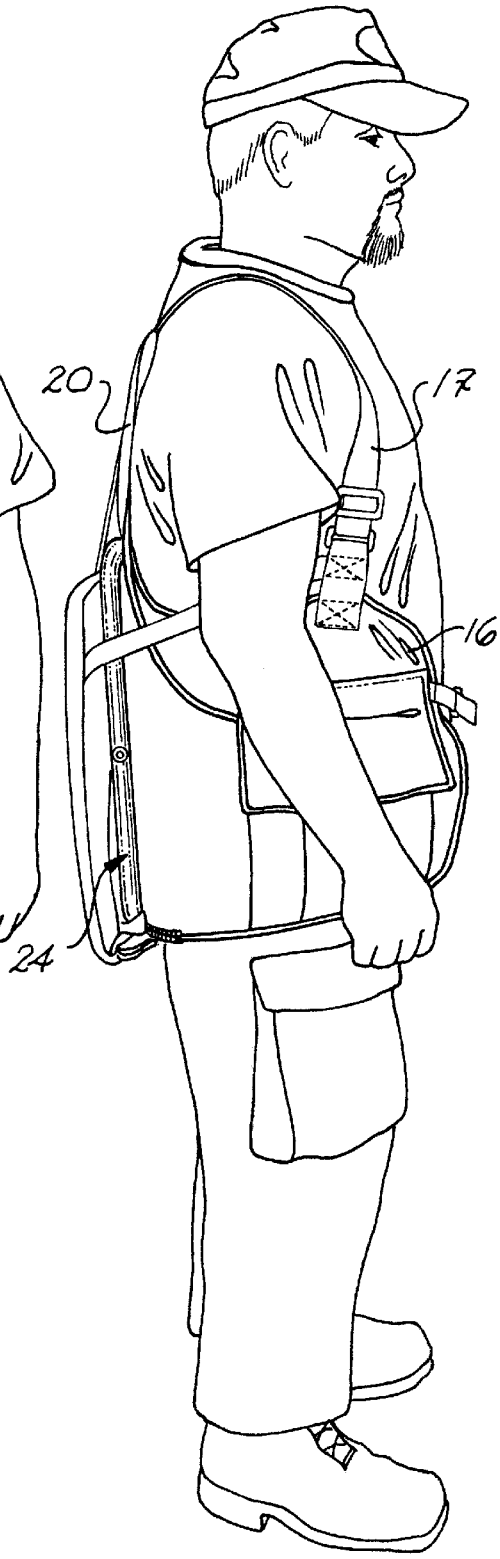
FIG. 2 is a perspective view taken from the side and showing the basic features of the embodiment of FIG. 1.
Figure 3A:
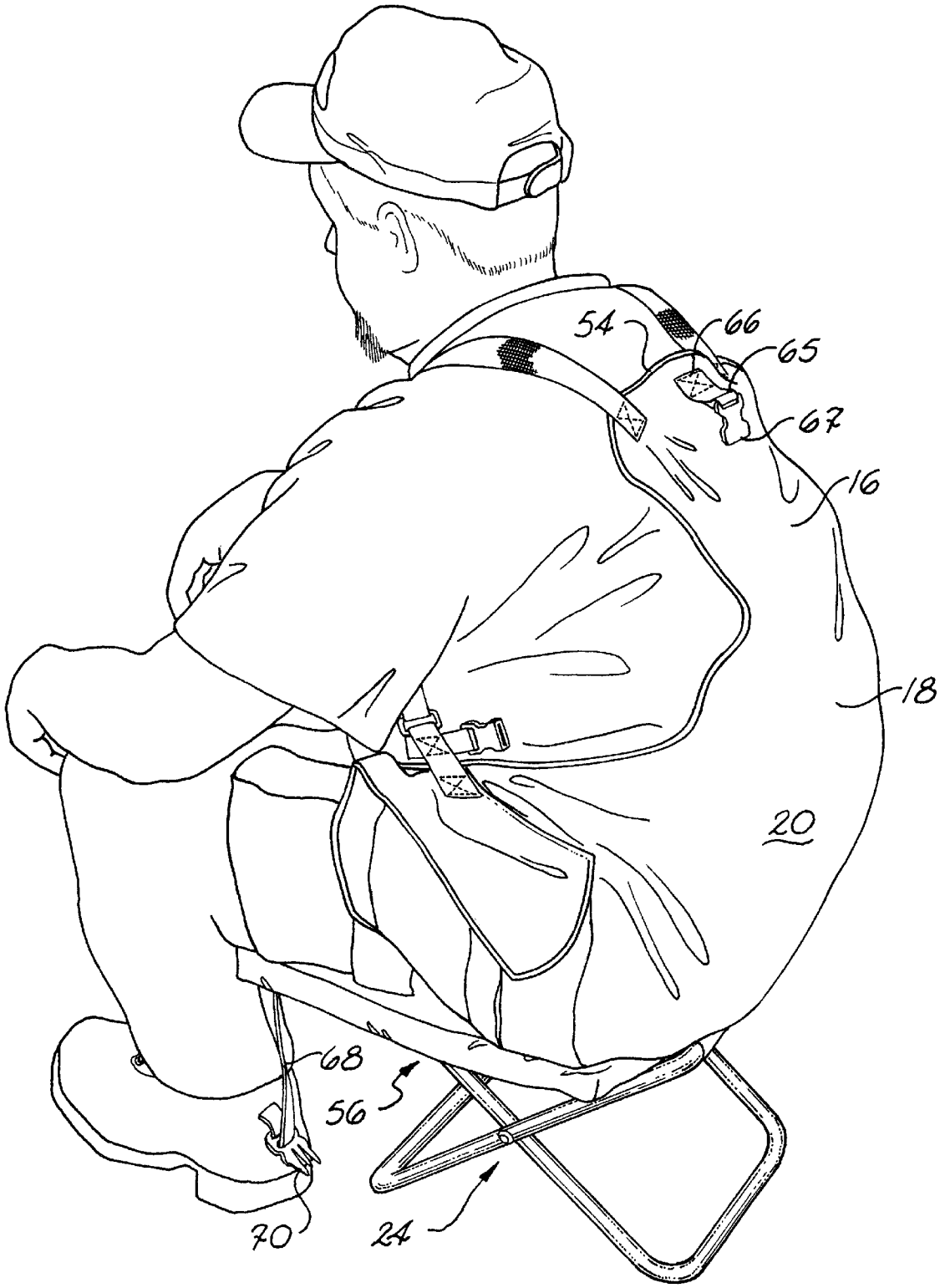
FIG. 3A is a perspective view of the embodiment of FIGS. 1 and 2, showing the seat and stand deployed beneath the user.
Figure 5:
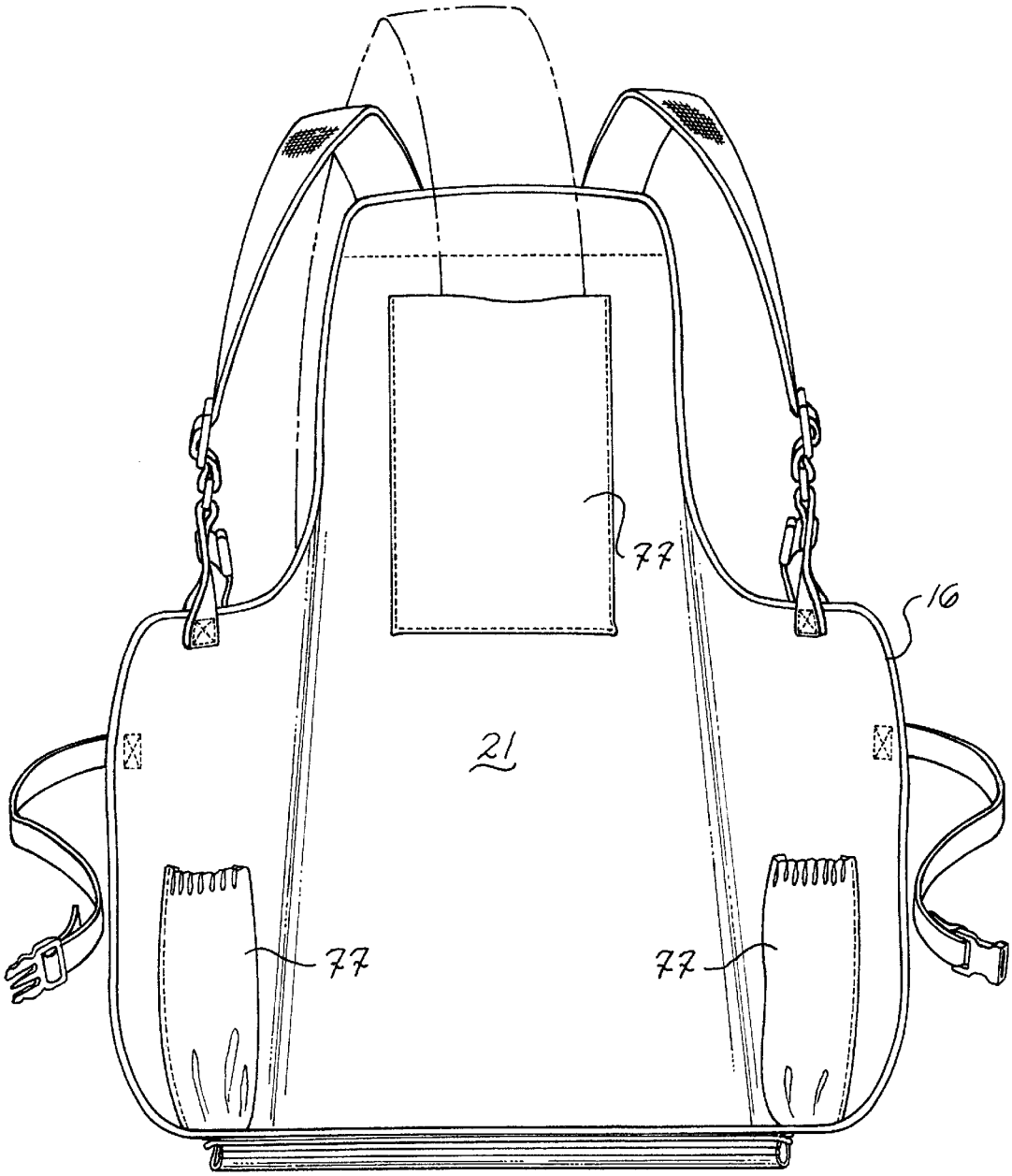
FIG. 5 is a perspective view of the interior of one embodiment of the invention.
Figure 6:
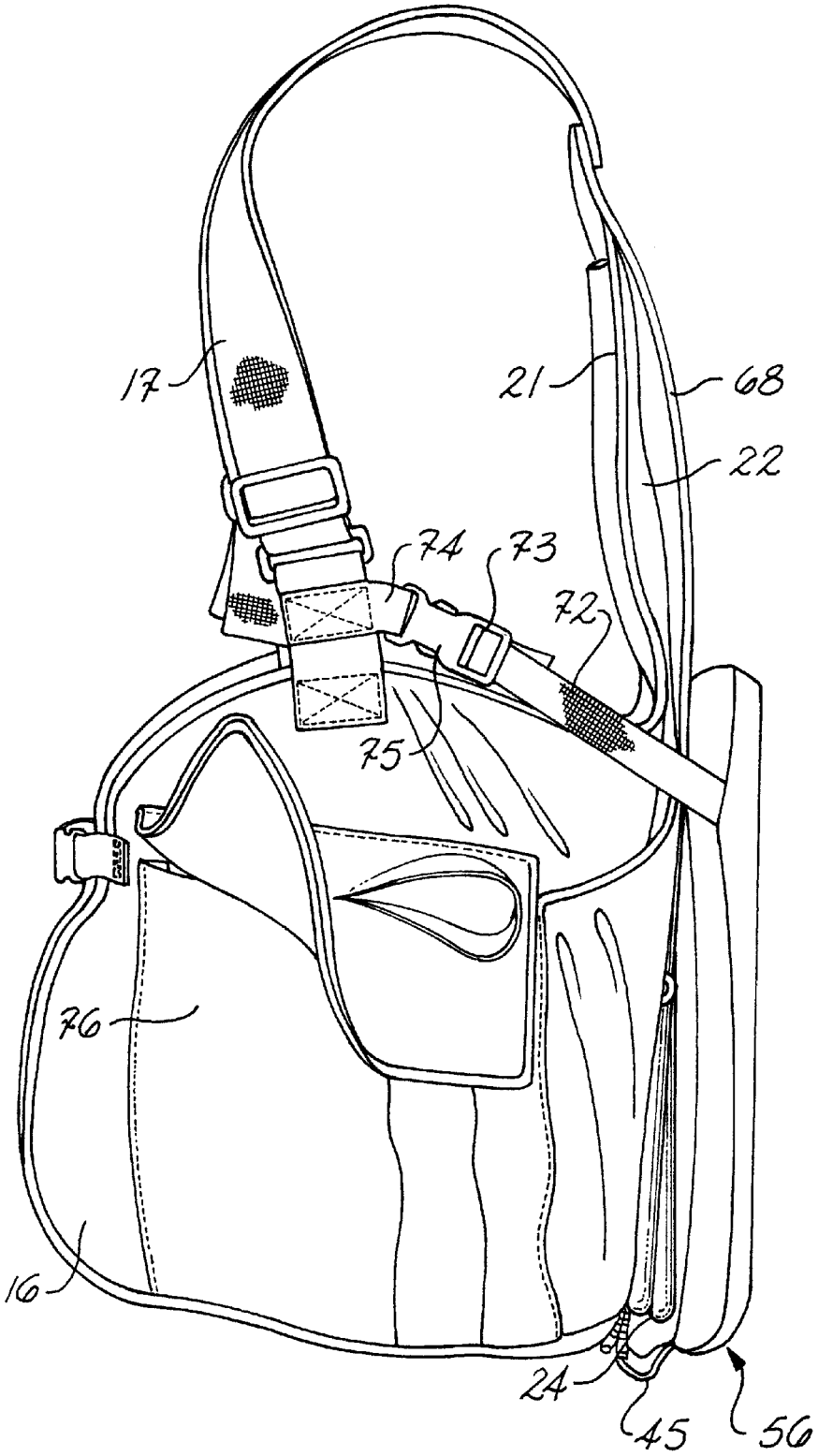
FIG. 6 is a perspective view taken from the side of one embodiment of the invention.

The present invention includes a garment for wear upon the body of the user. As embodied herein and shown in FIGS. 1 and 2 for example, such a garment 16 is illustrated as a vest with a pair of shoulder straps 17 and a rear bib 18. However, other embodiments of the garment include but are not limited to a jacket, a coverall, and a simple shoulder strap harness. As shown in FIG. 1 for example, the garment has a front 19. As shown in FIG. 3A for example, the garment defines a rear 20 that is disposed opposite the front. As shown in FIG. 5 for example, the garment 16 has an interior surface 21 disposed adjacent to the wearer when worn. As shown in FIG. 6 for example, garment 16 includes an exterior surface 22 disposed opposite the interior surface 21.

In further accordance with the present invention, a collapsible stand is provided and configured to be pivotally connected to the rear of the garment. The collapsible stand is configured so as to be selectively deployable by the wearer of the garment from a first mode to a second mode while the stand remains connected to the garment and the garment is continuously worn by the wearer. As shown in FIG. 2 for example, the first mode defines a collapsed storage mode in which the stand, which is generally indicated by the numeral 24, is configured for essentially flat storage parallel to and against the rear of the garment. As shown in FIG. 3A for example, the second mode defines an open seating mode in which the stand 24 is configured for supporting the wearer of the garment 16 elevated above the ground in a seated position. During the seating mode, the stand is configured to be capable of supporting the user's weight.

Figure 7D:
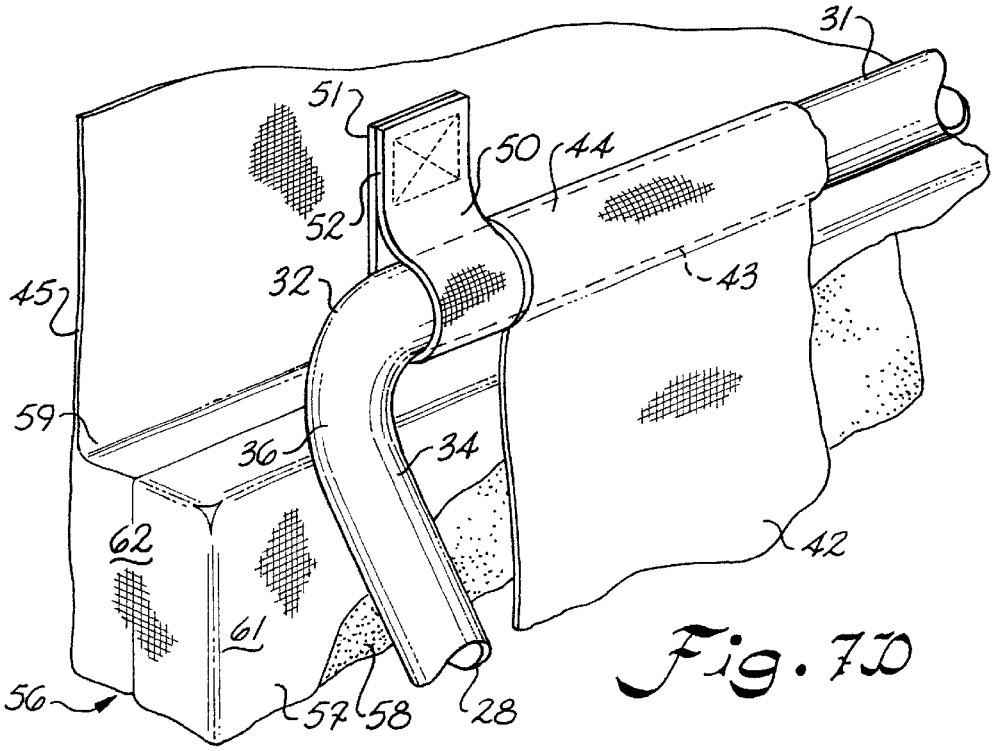
FIG. 7D is an enlarged perspective partial view of components of an embodiment of the invention.
Figure 7A:
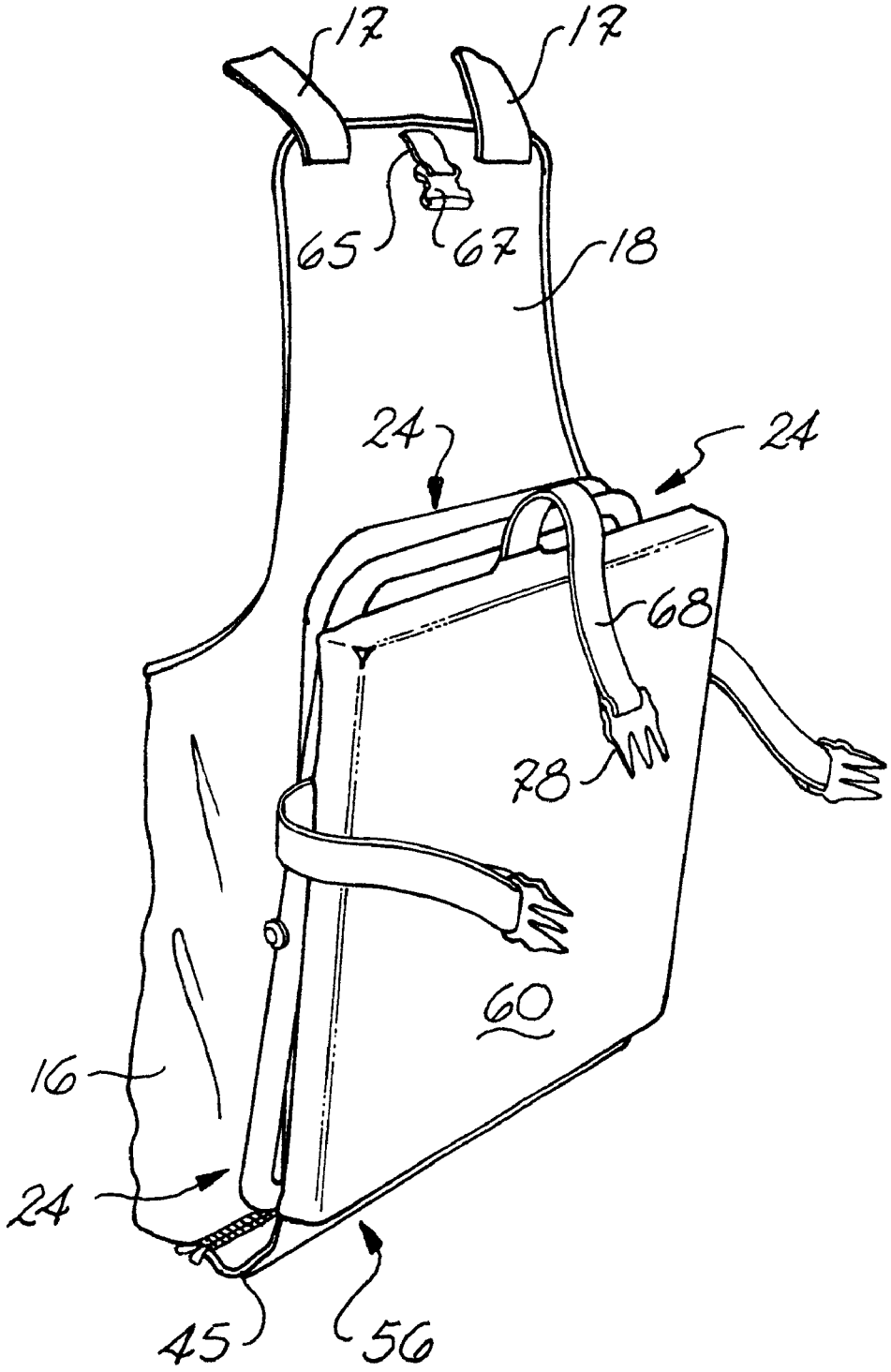
FIG. 7A is a perspective view of components at the rear of an embodiment of the invention, showing the seat in a stowed position just after the fastener has been detached from the garment.
Figure 7B:
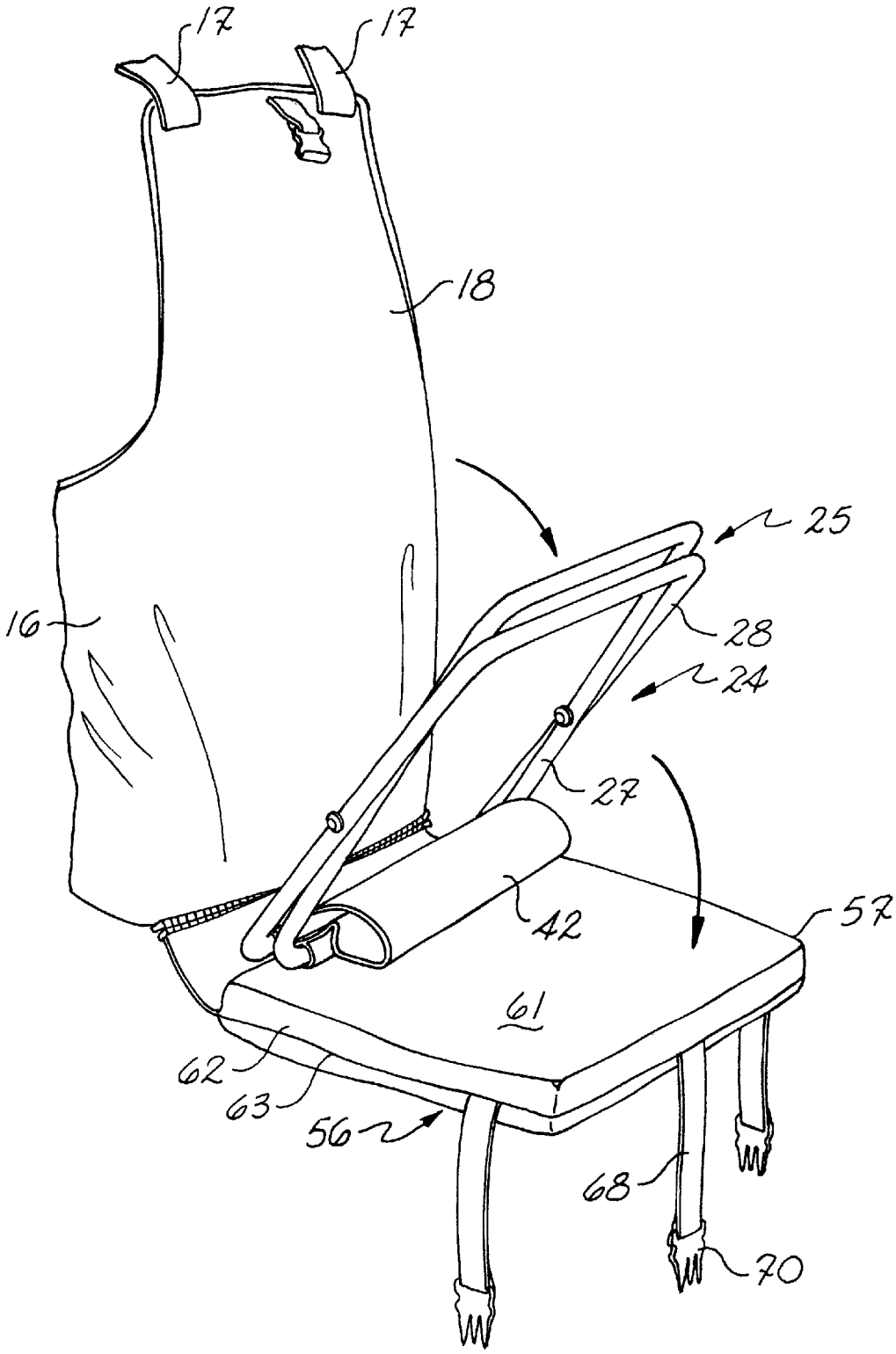
FIG. 7B is a perspective view of components of an embodiment of the invention, showing the seat and stand being deployed from the storage mode toward a position for seating.

As embodied herein and shown in FIG. 7B for example, the collapsible stand 24 includes a frame, which is generally designated by the numeral 25, and a bridge member 26. As embodied herein and shown in FIGS. 7C and 8 for example, the frame 25 includes a first brace 27 and a second brace 28 pivotally connected to the first brace 27. Each brace defines a rigid member that desirably is capable of supporting several hundred pounds without bending or breaking. Suitable material for forming each brace 27, 28 can include metal such as structural aluminum tubing. Wood or tubing formed of carbon fiber or other composite material also would suffice.

Figure 3B:
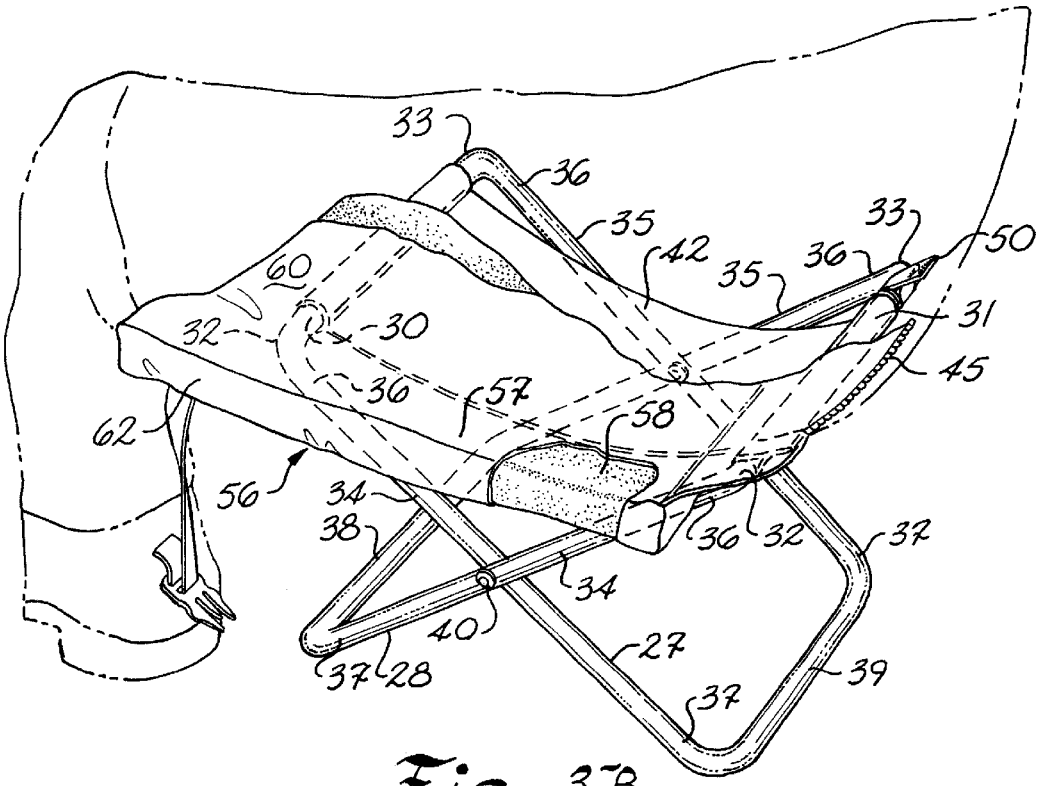
FIG. 3B is a perspective view of the embodiment of FIGS. 1 and 2, showing the seat and stand deployed beneath the user (shown in phantom) in the open seating mode.
Figure 7C:
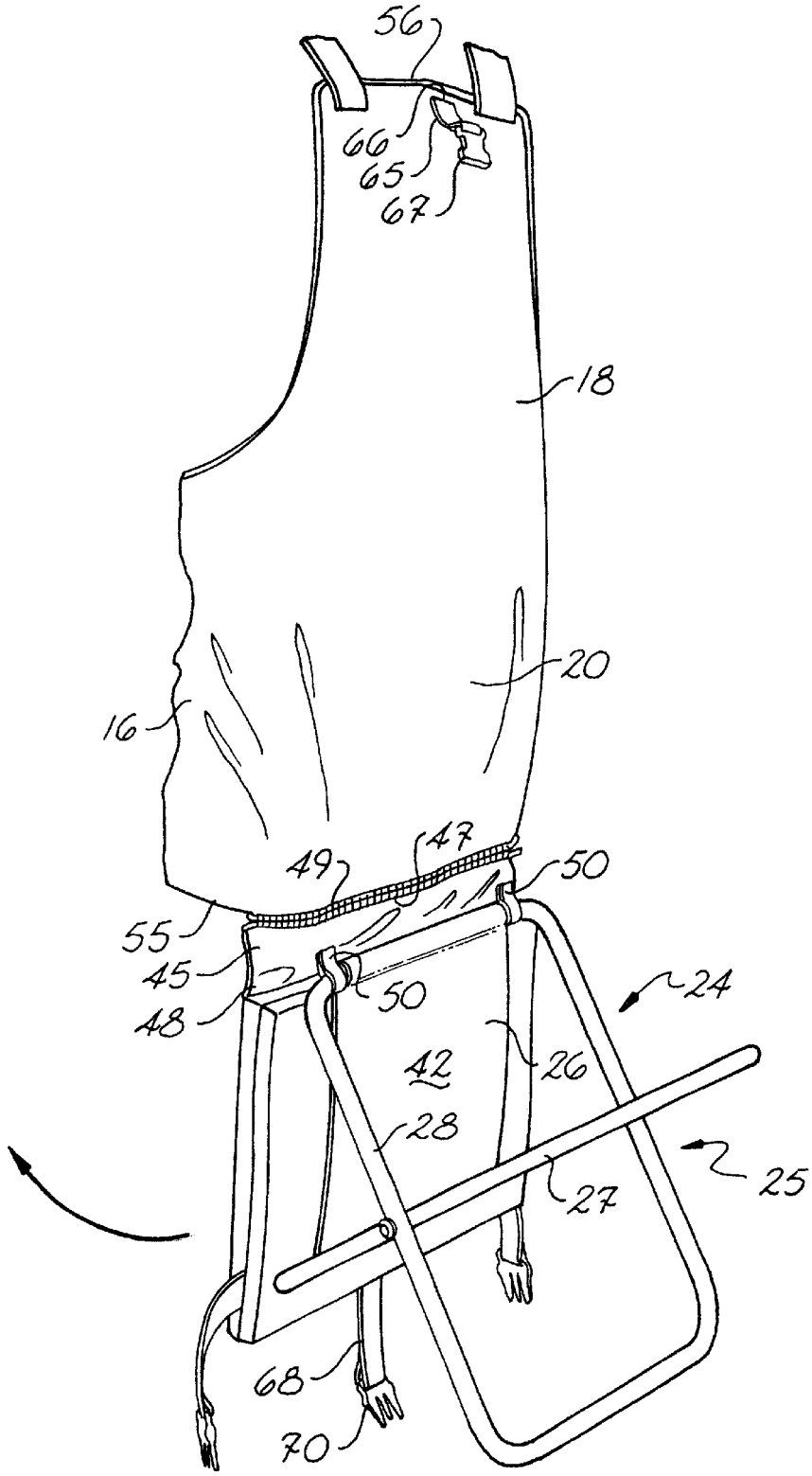
FIG. 7C is a perspective view of components of an embodiment of the invention, showing the seat and stand being deployed from the storage mode to a position in which the stand is in the open mode in preparation for seating.
Figure 8:
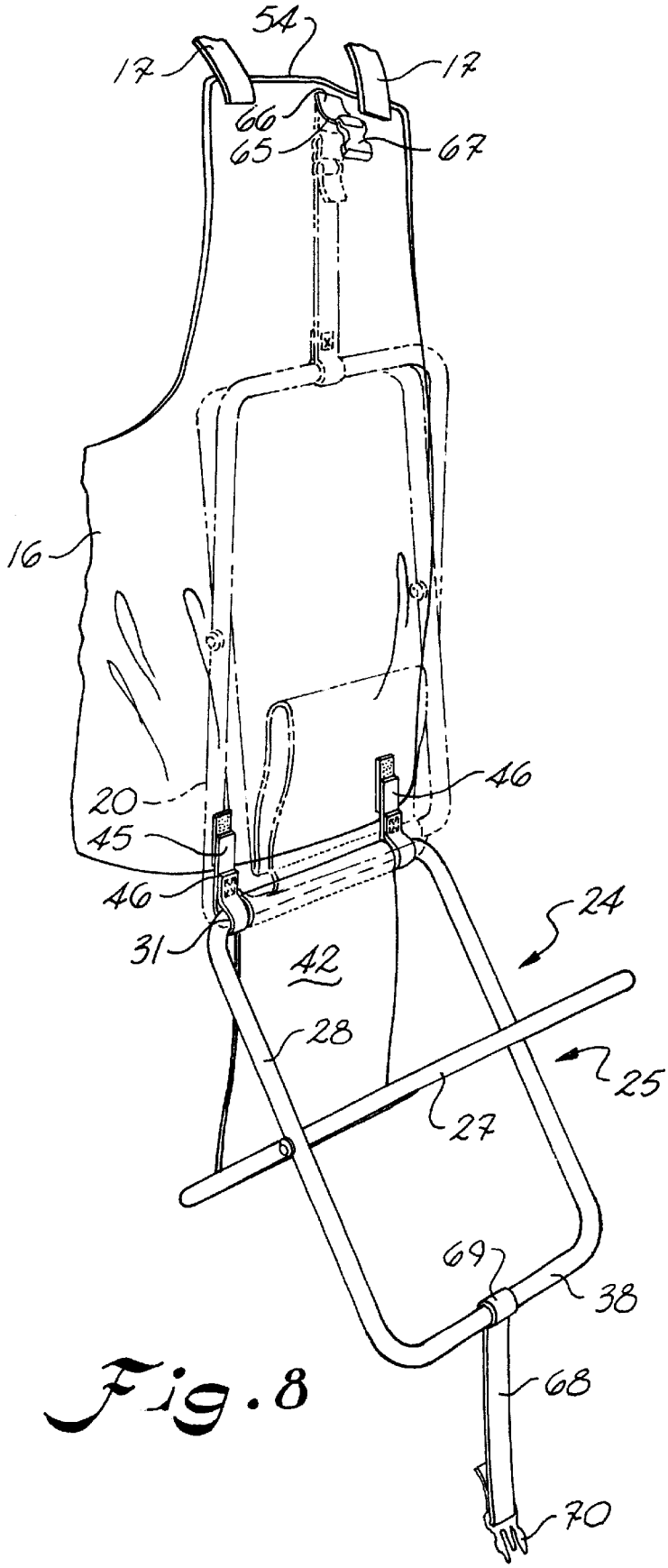
FIG. 8 is a perspective view of components of an alternative embodiment of the invention, showing the stand being deployed from a stowed position to an open mode in preparation of the position for seating the user.

As shown in FIG. 3B for example, each brace 27, 28 includes a top beam 30, 31 having a pair of opposed ends 32, 33. Each brace 27, 28 includes a pair of opposed legs 34, 35. Each leg 34, 35 has a top end 36 and a bottom end 37 disposed opposite the top end 36. The top end 36 of each leg 34, 35 depends from a different one of the opposed 32, 33 ends of the top beam 30, 31 of each brace 27, 28. As in the embodiment shown in FIG. 3B for example, the legs 34, 35 and top beam 30, 31 can be formed as a unitary member, but could be formed by separate pieces joined by welding or a mechanical fastener. Each brace 27, 28 can define a generally rectilinear outline and also can reside generally in a flat plane, but need not be of rectilinear shape and need not reside in a flat plane. In a presently preferred embodiment shown in FIG. 3B for example, each brace 27, 28 includes a bottom beam 38, 39 connecting the bottom ends 37 of each leg 34, 35 of the brace 27, 28. However, the bottom ends 37 of each leg 34, 35 can define free ends, if desired. The bottom beam 38, 39 provides further structural stability to the collapsible stand. Thus, a bottom beam 38, 39, if any, of each brace 27, 28 is configured and disposed to connect the bottom ends 37 of the legs 34, 35 of the brace 27, 28. Accordingly, and as shown in FIGS. 7C and 8 for example, each brace 27, 28 can define a rigid quadrilateral closed loop that resides generally in a flat plane. As in the embodiment shown in FIG. 3B for example, the legs 34, 35 and bottom beam 38, 39 can be formed as a unitary member, but could be formed by separate pieces joined by welding or a mechanical fastener.

As shown in FIG. 3B for example, each leg 34 of one brace 27 is pivotally connected to a different one of the legs 34 of the other brace 28. This can be accomplished by an axle 40 or pin disposed transversely through adjacent legs 34, 34 so that both legs 35, 35 can pivot with respect to one another. In the embodiment shown, the pivot point desirably is located generally at the mid-point of the pivotally connected legs 34, 35 of the braces 27, 28. However, the pivot point can be disposed at other than the mid-points of the legs, if desired. As will be appreciated, the pivotal engagement so defined enables the braces 27, 28 to be selectively collapsed against each other as shown in FIG. 7B for example or separated from each other by a scissors movement as shown in FIGS. 8 and 7C for example. The extent of the separation between the top beams 30, 31 of the two braces 27, 28 in the open seating mode of the stand 24 is determined by the length of the bridge member that is described more fully below.

As embodied herein and shown in FIGS. 8, 7C and 3B for example, the collapsible stand 24 includes a bridge member 42. As shown in FIG. 7D for example, the bridge member 42 has one end 43 engaging one of the top beams 31 of one of the braces 28. Bridge member 42 also defines a second end that is disposed opposite the first end 43 and that engages the top beam 30 of the other of the braces 27. The bridge member 42 is formed of material that is capable of withstanding several hundred pounds of tension, as this is the likely weight of the user that is to be supported by the bridge member. If desired, the bridge member 42 can be formed as a rigid structural planar plate member (not shown) that has one end configured to pivot around one top beam 30 and the opposite end configured to be carried by the other top beam 31. However, in presently preferred embodiments shown in FIGS. 8 and 7C for example, the bridge member 42 defines a non-rigid substrate. Such substrate can be formed of woven nylon for example, or of other suitable sturdy fabric.

As shown in FIGS. 8 and 7C for example, the bridge member 42 desirably is formed in a rectangular shape. As shown in FIG. 7D for example, each end of the bridge member 42 can be connected to the top beam of each brace by defining at least one hollow sleeve 44 that receives therein the top beam. The hollow sleeve portion 44 of each end of the bridge member 42 permits the bridge member to be rotated about each of the top beams 30, 31 while being permanently anchored to the top beams. In some embodiments, detachable snaps can be used to connect each sleeve 44 so that each end of the bridge member can be selectively detached from the top beam 30, 31 to facilitate repair or cleaning of the bridge member. However, any means of attachment of the bridge member to the braces must be strong enough to withstand the aforementioned tensional forces occasioned by the weight of the sitting user.

A presently preferred embodiment of the invention also includes a hinge member that pivotally attaches the stand to the garment. Desirably, the hinge member is configured and disposed so that the stand can be disposed selectively by the wearer of the garment, between the storage mode and the seating mode without the need for the wearer to detach the stand from the garment or disrobe the garment. In one presently preferred embodiment, the hinge member desirably includes a non-rigid substrate that pivotally attaches the stand to the rear of the garment.

As embodied herein and shown in FIG. 8 for example, the substrate forming part of the hinge member 45 defines at least one elongated non-rigid strap 46, and preferably a pair of such straps 46 is provided. As shown in FIG. 8 for example, one end of each strap 46 loops around the top beam 31 of one of the braces 28 of the frame 25 of the stand 24 and is attached to itself. This self-attachment can be permanent such as gluing, stitching or riveting for example. Alternatively, this self-attachment can be selectively detachable such as a snap or a hook and loop means of attachment. Desirably, any such detachable mechanism must be able to withstand the weight of the stand without detaching. As shown in FIG. 8 for example, the opposite end of each strap 46 is attached to the rear 20 of the garment 16. Again, this attachment can be permanent or selectively detachable, as desired, and if the latter then desirably should be capable of withstanding the weight of the stand without detaching.

As embodied herein and shown in FIG. 7C for example, the hinge member 45 can include a substrate that defines a front edge 47 and a back edge 48 disposed opposite the front edge 47. One of the edges 47,48 of the substrate is connected to the rear 20 of the garment 16, and in the embodiment shown in FIG. 7C for example, the front edge 47 is connected to the rear 20 of the garment 16. Desirably, the substrate is formed of the same material as the garment, but a different material is also contemplated. The material forming the hinge member 45 may be a textile fabric or a polymeric woven web. However, the substrate portion of the hinge member 45 may be formed of other materials such as plastic connection members, fabric straps, polymeric flanges, and the like. As shown in FIG. 7C for example, the hinge member 45 can be detachably connected to the rear 20 of the garment 16 by any suitable mechanism such as a zipper 49. A hook and loop fastener that was adherent enough to bear the weight of the stand 24, also would form a suitable mechanism that permits the user the additional option of selectively detaching the stand 24 from the garment 16.

In one presently preferred embodiment of the invention, the hinge member 45 includes at least one anchor member. As shown in FIGS. 7C and 7D for example, the at least one anchor member 50 pivotally connects one of the top beams 31 of one of the braces 28 to one of the substrate of the hinge member 45 and the seat member (described below). Moreover, more than one anchor member 50 desirably is provided to pivotally connect one of the top beams 31 of one of the braces 28 to the rear 20 of the garment 16 of the seat support system. As shown in FIG. 7D for example, the at least one anchor member 50 desirably can include an elongated, sturdy strand of non-rigid material. In the embodiments shown, the anchor member is illustrated as a nonrigid element, but may also be any other suitable device providing the function described, such as rigid rings, loops, hinges, flanges, and the like. The anchor member 50 can have a first end 51 and a second end 52 disposed opposite the length of the strand from its first end. The second end 52 of the strand desirably is attached to the first end 51 of the strand so as to define an enclosed loop. The first end 51 of the strand desirably is attached either to the hinge member's substrate or to the seat member (described below), depending on the embodiment of the invention.

As shown in FIGS. 8 and 3A for example, the rear 20 of the garment 16 can define an upper edge 54 that is disposed nearest the neck of the wearer (FIG. 3A) when the garment is being worn by the user. As shown in FIGS. 8 and 7C for example, the rear 20 of the garment 16 defines a lower edge 55 disposed farthest away from the upper edge when the garment is being worn by the user. As shown in FIGS. 8 and 7C, the hinge member 45 desirably is pivotally connected to the rear 20 of the garment 16 closer to the lower edge 55 of the rear of the garment than to the upper edge 54 of the rear of the garment. In the presently preferred embodiment shown in FIG. 7C for example, the hinge member 45 desirably is pivotally connected to lower edge 55 of the rear 20 of the garment 16.

In the embodiment shown in FIG. 7C for example, the hinge member 45 defines a width dimension, and the front edge 47 extends along the width dimension. The hinge member 45 defines a length dimension measured perpendicular to the width dimension, and the length dimension is shorter than the width dimension in the embodiment shown in FIG. 7C for example. As shown in FIGS. 7C and 8 for example, the length of the substrate or each strap forming the hinge member 45 must be sufficient so that enough clearance exists for the adjacent top beams 30, 31 of the collapsed stand 24 to be disposed near the lower edge 55 of the garment 16 while the bottom ends 37 of the stand's legs 34, 35 can be secured against the rear 20 of the garment 16 near the upper edge 54 of the garment. If the length of the hinge member 45 is too short, then the bottom ends 37 of the stand's legs (with or without the bottom beams, 38, 39 depending on the particular embodiment) will come to rest in the storage mode, too far away from the rear 20 of the garment 16, and this protruding condition is desirably to be avoided.

In accordance with a presently preferred embodiment of the invention, a seat member can be provided. As shown in FIG. 7B for example, the seat member is generally designated by the numeral 56. As shown in FIGS. 3B and 7D for example, the seat member 56 can be connected to the substrate of the hinge member 45 and can include a seat casing 57 and a cushion 58 configured to be disposed within the seat casing 57. The outline of the volume occupied by the cushion 58 can define rectilinear dimensions of length from front to back, width from side to side and thickness or depth from top to bottom. The thickness of the cushion 58 determines the substantial proportion of the thickness of the seat member 57 and can be varied depending upon the firmness of the cushion 58 for example. The cushion 58 defines a depth dimension (i.e., thickness) that is the shortest dimension that determines the volume occupied by the cushion 58. As embodied herein and shown in FIGS. 7D for example, the edge 59 of the hinge member 45 that is not connected to the garment, can be connected to the seat member 56. The length dimension of the hinge member 45 is desirably greater than the depth dimension of the cushion 58 in order to accommodate storage of the stand 24 and seat member 56 as shown in FIG. 6 for example.

As shown in FIGS. 3B and 7C for example, the casing 57 can define a body that has a top 60, a bottom 61 disposed opposite the top 60, and a peripheral border 62 that extends between the top 60 and the bottom 61. The casing 57 is hollow and desirably is formed of non-rigid material such as a woven textile fabric made of either natural fibers or man made fibers. It also is possible to form the casing 57 from a non-woven sheet of polymeric material. The hollow interior of the seat casing 57 defines a cushion compartment therein. The top 60 of the seat casing 57 can be formed as a unitary structure with the peripheral border 62 and with the bottom 61 of the seat casing 57. The border 62 could be sewn on its perimeter to the top 60 of the casing 57 and the opposite perimeter 62 could be sewn to the bottom 61 of the casing 57. A recloseable opening (not shown) can be provided in the seat casing 57 in order to permit the user to remove the cushion 58 and replace it with a substitute cushion of the same or different degree of firmness and elasticity. In the embodiment shown in FIG. 7C for example, the peripheral border 62 of the casing 57 includes a centrally disposed seam 63, and the top 60 is a unitary structure with the top half of the peripheral border 62. The bottom 61 is similarly a unitary structure with the bottom half of the border 62.

In one presently preferred embodiment, the cushion 58 defines a non-rigid resilient solid substrate member. The stiffness of the cushion 58 can be varied and can range from very firm to very soft. The cushion 58 can be formed of a resilient material such as open cell polyurethane foam or can be formed of non-woven, fibrous batting composed of cotton or a firmer material such as straw.

As embodied herein and shown in FIGS. 8 and 7C for example, at least one fastener is configured and disposed to removably fasten the stand 24 and the seat member 56 to the exterior surface of the rear 20 of the garment 16. In the embodiments shown in FIGS. 3A and 8 for example, the fastener includes a non-rigid belt 65 having one end 66 attached to the garment 16 and the free end attached to a slide receiver 67. In the embodiment shown in FIG. 8 for example, a second non-rigid belt 68 has one end 69 attached to the bottom beam 38 of one of the braces 28 and its free end attached a slide 70 that is configured to be detachably inserted into and received within the slide receiver 67. In the embodiment shown in FIG. 7C for example, the second non-rigid belt 68 has one end attached to the seat casing 57. The fastener is configured to be selectively releasable. As embodied herein, the selectively releasable fastener may include a snap fit buckle formed of interfitting plastic members 67, 70, one male member 70 received in a mating female member 67. However, other suitable means of fastening the collapsible stand 24 in its storage mode against the rear 20 of the garment 16 can be provided by mechanical snaps, hook and loop gripping fabric members, hooks and eyelets, and the like. Connections of this type are articles of general commerce, all of which are suitable, and will not be described further herein.

In the embodiment shown in FIGS. 6 and 7A for example, the fastener that retains the stand 24 and the seat 56 in the storage mode can include a second and third pair of belts. Each additional pair of selectively detachable belts connects one side of the seat casing to the corresponding side of the garment. In the embodiment shown in FIG. 6 for example, one end of one of the belts 72 in one of the two additional pairs of belts is connected to one side of the seat casing and terminates with one end of a connector 73. The mating belt 74 in the pair has one end connected to a shoulder strap 17 of the garment 16 and terminates in the mating end of the connector 75. A similar arrangement is provided on the other side of the casing and the shoulder strap on the other side of the garment.

The invention provides ease of deployment of the seat system, for seating by a user who has been transporting the system in the storage mode. Such deployment of the embodiment shown in FIG. 7C for example is accomplished by loosing the detachable fasteners, an undertaking that requires minimal involvement by the user. So loosed, the system, including the collapsible stand 24 and the seat member 56, fall by gravity downward, with the hinge 45 configured to hold the seat member 56 in a position adjacent to the user. Upon the loosing of the fasteners, the hinge member 45 also disposes the stand 24 to fall by gravity and open to the seating mode in a position adjacent to the seat member 56. However, the fall of the collapsible stand 24 is constrained by the bridge member 42, to a predetermined relative position. With the seating system so configured by such deployment, the user of the seating system may squat to a seated position upon the seat member 56 containing the cushion 58.

The seat support assembly provides support and elevation when the seat system is deployed in the seating mode. The braces 27, 28 of the stand 24 fold against one another and against the garment 16 when the system is collapsed into the storage mode of operation, which is illustrated in FIGS. 6 and 7A, to provide compactness to the assembly for ease of transport. So configured, one of the braces is pivotally attached to the hinge member, to allow the braces to be unfolded from their stowed position (as illustrated in FIGS. 6 and 7A), to an open seat mode (as illustrated in FIGS. 3A, 3B, 7C and 8). With such support in elevation provided by the braces, a user of the invention is provided a comfortably elevated seated position(as illustrated in FIGS. 3A and 3B), yet with an increased field of view and greater maneuverability from side-to-side. Additionally, such elevation of the user provided by the braces preserves dryness for the user during wet conditions.

The invention provides ease of transition from a seated position to a storage mode of the invention. From the seated position illustrated in FIG. 3A for example, this embodiment of the invention allows the user to arise, easily fold the collapsible stand 24 against the seat 56, pivotally move the collapsible stand 24 and seat member 56 to a transport position alongside the rear 20 of the garment 16 as illustrated in FIG. 7A for example, and secure the collapsible stand 24 and seat member 56 to the garment by means of the fasteners 65, 67, 68, 70. The user may then easily walk to another location while conveniently transporting the wearable seat system to the new location without encumbering one's hands with the seat system.

Figure 4:
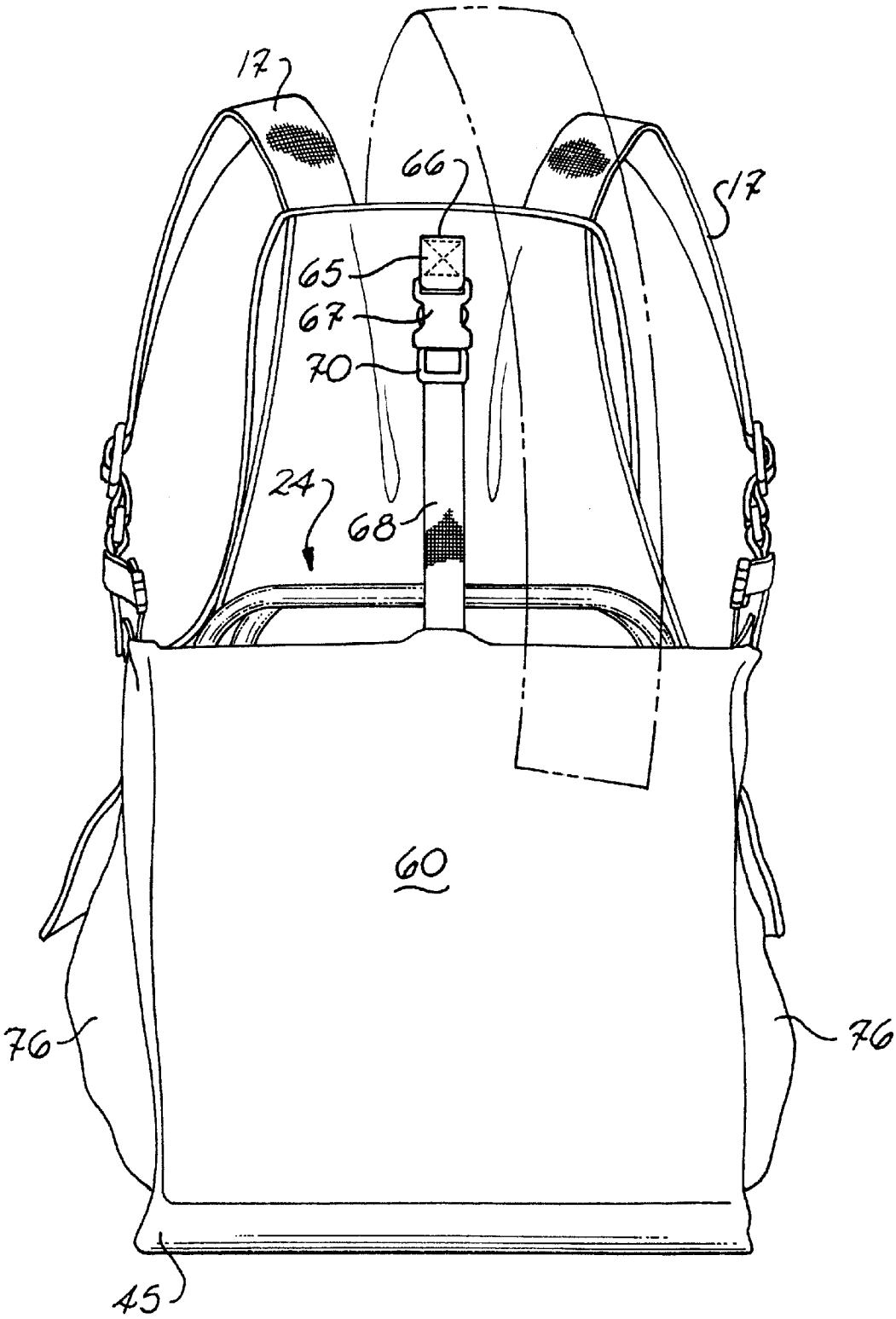
FIG. 4 is a perspective view of the exterior surface of the back of the embodiment of FIG. 1.

In one embodiment, illustrated in FIGS. 1 and 4 for example, the garment 16 forming part of the seating system includes numerous external pockets or pouches 76 for transport of sporting gear into and from the field. In the embodiment shown in FIG. 5 for example, the garment 16 forming the seating system includes numerous internal pockets 77. In any of the foregoing embodiments, the seating system can include a fabric polymeric facing unit of blaze orange color attached to the garment 16. This orange colored facing alternately may be stored in a pocket 76, 77 or extracted therefrom to display the user's presence to others in the field so as to promote safety. In the embodiment shown in FIGS. 1 and 5 for example, the seating system is secured to the garment by means of straps and interlocking plastic buckles, but any suitable means of securement may be used, such as buttons, snaps, or the like.

Various modifications and variations can be made in the embodiments of the present invention without departing from the scope and spirit of the invention. It is intended that the present invention include such modifications and variations as come within the scope of the appended claims and their equivalents.

What is claimed is:

1. A wearable seat system, comprising:

a garment, said garment having a front and a rear disposed opposite said front, said rear having an interior surface disposed to face the wearer thereof and an exterior surface disposed opposite said interior surface;

a hinge member, said hinge member defining a first non-rigid substrate having a front edge and a back edge disposed opposite said front edge, one of said edges being connected to said rear of said garment;

a seat member connected to the other of said edges of said hinge member, said seat member including a seat casing and a cushion, said seat casing defining a hollow non-rigid body defining a cushion compartment therein, said seat casing defining a top, a bottom disposed opposite said top, and a peripheral border extending between said top and said bottom, said cushion being configured to be received within said cushion compartment of said seat casing;

a collapsible stand configured to be selectively deployed for supporting the user above the ground in a seated position, said stand including a frame and a bridge member;

said frame including a first brace and a second brace pivotally connected to said first brace, each said brace including a top beam having a pair of opposed ends, each said brace including a pair of opposed legs, each said leg depending from a different one of said opposed ends of said top beam of each said brace;

said bridge member having one end connected to one of said top beams of one of said braces and having a second end disposed opposite said first end and connected to said top beam of the other of said braces; and at least one anchor member, said anchor member being configured to pivotally connect one of said top beams of one of said braces to one of said hinge member and said seat member.

2. A wearable seat system as in claim 1, wherein said hinge member and said stand are configured to support the user above the ground in a seated position while said seat member is attached to said garment.

3. A wearable seat system as in claim 1, further comprising:

at least one fastener attached to said rear of said garment and configured and disposed to selectively detachably fasten said stand and said seat member to said exterior surface of said rear of said garment.

4. A wearable seat system as in claim 3, wherein said fastener includes a first strap connected to said exterior surface of said rear of said garment, a first connector attached to a free end of said first strap, a second strap connected to said seat member, and a second connector attached to a free end of said second strap and configured to be selectively connected to said first connector.

5. A wearable seat system as in claim 1, wherein said rear of said garment defines an upper edge disposed nearest the neck of the wearer when said garment is being worn by the user, said rear of said garment defines a lower edge disposed farthest away from said upper edge when said garment is being worn by the user, said hinge member being connected to said rear of said garment closer to said lower edge of said rear of said garment than to said upper edge of said rear of said garment.

6. A wearable seat system as in claim 1, wherein said front edge of said hinge member is configured to be selectively detachably connected to said rear of said garment.

7. A wearable seat system as in claim 6, wherein said front edge of said hinge member is connected by a zipper to said rear of said garment.

8. A wearable seat system as in claim 1, wherein said bridge member defines a non-rigid substrate.

9. A wearable seat system as in claim 1, wherein each said leg of said first brace is pivotally connected to a different one of said legs of said second brace.

10. A wearable seat system as in claim 1, wherein each said brace defines a rigid rectilinear member residing generally in a flat plane.

11. A wearable seat system as in claim 1, further comprising at least one pocket connected to said interior of said garment.

12. A wearable seat system, comprising:

a garment, said garment having a front and a rear disposed opposite said front, said rear having an interior surface disposed to face the wearer thereof and an exterior surface disposed opposite said interior surface;

a collapsible stand pivotally connected to said rear of said garment, said collapsible stand being configured so as to be selectively deployable by the wearer of said garment from a first mode to a second mode while said stand remains connected to said garment and said garment is continuously worn by the wearer, said first mode defining a collapsed storage mode and said second mode defining an open seating mode, said stand being configured for supporting the wearer of said garment above the ground in a seated position during said seating mode, said stand being configured for essentially flat storage parallel to and against said rear of said garment during said storage mode, said stand including a frame and a bridge member;

said frame including a first brace and a second brace pivotally connected to said first brace, each said brace including a top beam having a pair of opposed ends, each said brace including a pair of opposed legs, each said leg depending from a different one of said opposed ends of said top beam of each said braces; and said bridge member having one end engaging said top beam of said first brace and having a second end disposed opposite said first end and engaging said top beam of said second brace.

13. A wearable seat system as in claim 12, wherein said rear of said garment defines an upper edge disposed nearest the neck of the wearer when said garment is being worn by the user, said rear of said garment defines a lower edge disposed farthest away from said upper edge when said garment is being worn by the user, said stand being pivotally connected by a non-rigid strap to said rear of said garment closer to said lower edge of said rear of said garment than to said upper edge of said rear of said garment.

14. A wearable seat system as in claim 12, further comprising:

a hinge member, said hinge member defining a first non-rigid substrate having a front edge and a back edge disposed opposite said front edge, one of said edges being connected to said rear of said garment; and a seat member connected to the other of said edges of said hinge member, said seat member including a seat casing and a cushion, said seat casing defining a hollow non-rigid body defining a cushion compartment therein, said seat casing defining a top, a bottom disposed opposite said top, and a peripheral border extending between said top and said bottom, said cushion being configured to be received within said cushion compartment of said seat casing.

15. A wearable seat system as in claim 14, wherein said front edge of said hinge member is configured to be selectively detachably connected to said rear of said garment.

16. A wearable seat system as in claim 14, wherein said front edge of said hinge member is configured to be selectively detachably connected to said rear of said garment.

17. A wearable seat system as in claim 16, wherein said front edge of said hinge member is connected by a zipper to said rear of said garment.

18. A wearable seat system as in claim 12, further comprising:

at least one fastener attached to said rear of said garment and configured and disposed to selectively detachably fasten said stand to said exterior surface of said rear of said garment.

19. A wearable seat system, comprising:

a garment, said garment having a front and a rear disposed opposite said front, said rear having an interior surface disposed to face the wearer thereof and an exterior surface disposed opposite said interior surface;

a hinge member, said hinge member defining a first non-rigid substrate having a front edge and a back edge disposed opposite said front edge, one of said edges being connected to said rear of said garment;

a seat member connected to the other of said edges of said hinge member, said seat member including a seat casing and a resilient cushion, said seat casing defining a hollow flexible body defining a cushion compartment therein, said seat casing defining a top, a bottom disposed opposite said top, and a peripheral border extending between said top and said bottom, said cushion being configured to be received within said cushion compartment of said seat casing;

a collapsible stand configured to be selectively deployed for supporting said seat member above the ground with the user's weight carried on said seat member, said stand including a frame and a bridge member;

said frame including a first brace and a second brace pivotally connected to said first brace, each said brace defining a rigid rectilinear member residing generally in a flat plane, each said brace including a pair of opposed legs, each said leg having a top end and a bottom end disposed opposite said top end, each said brace including a top beam connecting said top ends of said brace, each said leg of said first brace being pivotally connected to a different one of said legs of said second brace;

said bridge member having one end connected to one of said top beams of one of said braces and having a second end disposed opposite said first end and connected to said top beam of the other of said braces;

at least one anchor member, said anchor member being configured to pivotally connect one of said top beams of one of said braces to one of said hinge member and said seat member; and at least one fastener configured and disposed to detachably fasten said stand and said seat member to said exterior surface of said rear of said garment.

* * * * *